US006044611A

United States Patent [19]

Brunett

[11] Patent Number: 6,044,611

[45] Date of Patent: Apr. 4, 2000

[54] WINDOW TRIM CLIP

[75] Inventor: John Brunett, Vienna, W. Va.

[73] Assignee: Simonton Building Products, Inc., Pennsboro, W. Va.

[21] Appl. No.: 09/047,421

[22] Filed: Mar. 25, 1998

[51] Int. Cl.[7] ..... E04C 2/38

[52] U.S. Cl. ..... 52/656.5; 52/204.1; 52/208; 52/211; 52/213; 52/656.6; 52/717.01; 52/717.03; 52/717.05; 16/389

[58] Field of Search ..... 52/656.5, 656.6, 52/204.1, 208, 211, 717.05, 717.03, 717.01, 213; 16/389

[56] References Cited

U.S. PATENT DOCUMENTS

| | | | |
|---|---|---|---|
| 2,771,042 | 11/1956 | Deaton | 109/64 |
| 3,139,703 | 7/1964 | Hilt | 50/118 |
| 3,583,114 | 6/1971 | Belfor . | |
| 3,729,870 | 5/1973 | Kvalheim et al. . | |
| 4,019,303 | 4/1977 | McAllister . | |
| 4,821,472 | 4/1989 | Tix | 52/213 |
| 4,999,957 | 3/1991 | Kessler . | |
| 5,119,609 | 6/1992 | Tait et al. . | |
| 5,265,388 | 11/1993 | Sherwood . | |
| 5,454,144 | 10/1995 | Rupprechter | 16/382 |
| 5,572,840 | 11/1996 | Fast et al. . | |
| 5,660,010 | 8/1997 | Sayers | 52/217 |

*Primary Examiner*—Christopher T. Kent
*Assistant Examiner*—Nkeisha J. Maddox
*Attorney, Agent, or Firm*—Cesari and McKenna, LLP

[57] ABSTRACT

A trim clip hooks onto a main frame of a window and positions wood or vinyl trim (i) parallel to a head, sill or a side jamb of the main frame, and (ii) extending outwardly from an interior wall of the main frame. The clip includes a hinged, outwardly extending base and an inverted J-shaped section that is perpendicular to the base and extends along the interior wall of the main frame. The trim is attached to the section of the base that rotates about the hinge. When the section of the base to which the trim is attached rotates in one direction, it draws the trim essentially parallel to the head, sill or side jamb of the main frame. When section of the base rotates in the opposite direction it orients the trim such that the trim extends outwardly from the interior wall of the main frame, and an end of the trim is held by the J-shaped section of the clip. A downwardly projecting lip on the end of the J-shaped section grips the end of the trim, to prevent the trim from rotating under its own weight away from the interior wall. The base of the trim clip includes a detent that is shaped to mate with a hook that extends outwardly from the main frame.

8 Claims, 3 Drawing Sheets

WINDOW TRIM CLIP

FIELD OF THE INVENTION

The invention relates generally to windows and, more particularly, to vinyl windows.

BACKGROUND OF THE INVENTION

Vinyl windows are typically fully assembled at the manufacturers before being shipped to a site for installation. This saves construction time, and relieves the developer from having to know how to assemble various types and brands of vinyl windows.

The assembled windows are generally transported from the manufacturer or between a distributor and the installation site in trucks. The more windows that can be transported at a time, the less expensive the delivery per window.

An assembled window includes a main frame that consists of a head, a sill and two side jambs and, as appropriate, upper and lower sashes that are contained within the main frame. Nailing fins, which are used to secure the window to the structure into which it is installed, attach to the main frame and extend upwardly from the head, sideways from the side jambs and downwardly from the sill. The nailing fins thus increase the overall length and width of the window. The window also includes wood or vinyl trim, which is commonly referred to as "woodbuck trim," that attaches to the interior face of the main frame. The trim is relatively wide and extends outwardly from the main frame such that it increases the depth of the window.

To reduce the size of the window for shipping, known prior windows may include foldable or pivotable nailing fins. The fins, which are relatively thin strips of vinyl, may fold against or wrap around the main frame. The fins are then held in place by straps or other packaging. When the packaging is removed, the fins unfold to their original breadth.

The trim cannot be similarly folded because it is relatively wide and is many times heavier than the nailing fin. Indeed, in known prior assemblies there is no mechanism to manipulate the trim in order to reduce the depth of the window for shipping.

SUMMARY OF THE INVENTION

A window constructed in accordance with the invention includes one or more hinged trim clips that hook onto the main frame and position wood or vinyl trim (i) parallel to a head, sill and/or side jambs of the main frame and (ii) extending outwardly from interior walls of the main frame. The clip thus positions the trim appropriately for shipping and for installation.

The trim clip includes a hinged, outwardly extending base to which the trim is attached, and an inverted J-shaped section that is perpendicular to the base and extends along the interior wall of the main frame. When the base rotates in one direction, it draws the trim essentially back along, or parallel to, a peripheral wall of the main frame. When the base rotates in the opposite direction, it orients the trim such that the trim extends outwardly from an interior wall of the main frame. In the outwardly extending orientation, the end of the trim that is closest to the main frame fits into and is held in place by the J-shaped section of the clip. A downwardly projecting lip on the end of the J-shaped section grips the end of the trim, to prevent the trim from rotating under its own weight.

The trim clip attaches to a hook that extends outwardly from the main frame. The clip is thus easily installed.

Further, the trim is readily attached to the base of the clip by, for example, stapling the trim to the outermost section of the base. Thus, the clips do not substantially complicate or lengthen the window assembly process.

BRIEF DESCRIPTION OF THE DRAWINGS

The invention description below refers to the accompanying drawings, of which.

DETAILED DESCRIPTION OF AN ILLUSTRATIVE EMBODIMENT

Figure 1:
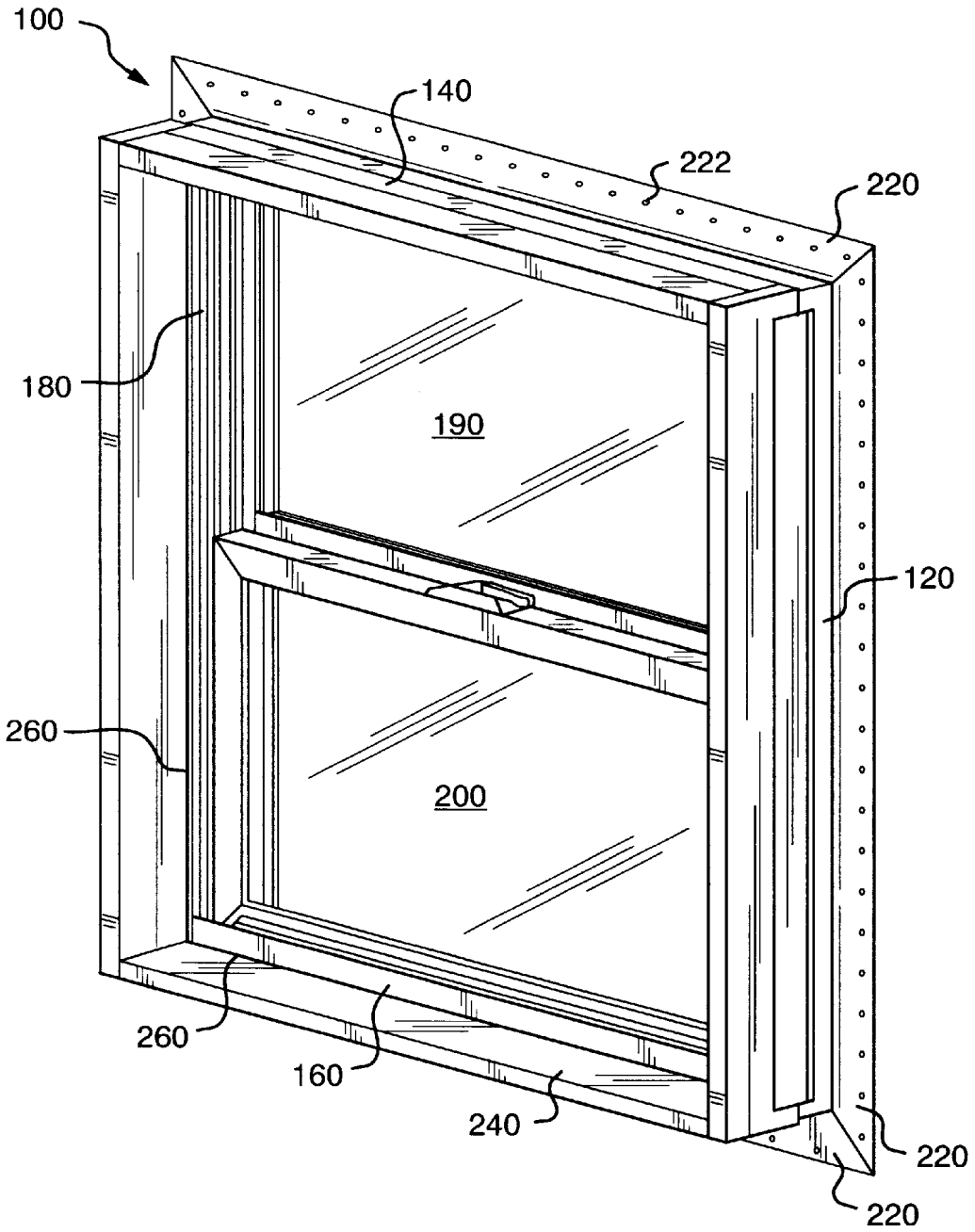
FIG. 1 is an illustration of a window constructed in accordance with the invention.

Referring to FIG. 1, a window 100 is fully assembled and ready for installation. The window 100 includes a main frame 120 that consists of a head 140, a sill 160 and side jambs 180. The window 100 shown in the drawing is a double hung window, and the main frame surrounds upper and lower sashes 190 and 200. Optionally, the window may be a single hung window, or it may be a sliding window, with the main frame surrounding the appropriate sashes.

One or more nailing fins 220, each of which is essentially a thin strip of vinyl, are attached to the exterior of the main frame and extend upwardly from the head 140, downwardly from the sill 160 and to the sides of the side jamb 180. As shown, the nailing fins 220 include optional nail holes 222.

The window 100 also includes wood or vinyl trim 240, which is commonly referred to as "woodbuck trim." The trim, which is essentially as wide as the interior wall 122 (FIG. 2) of the frame 120, extends outwardly from interior walls. Clips 260, which are described in more detail with reference to FIGS. 2 and 3 below, hold the trim 240 in place.

For shipping, the clips 260 rotate the trim 240 back against, or parallel to, the head 140, jambs 180 and the sill 160 of the main frame 120, to reduce the thickness of the window 100. Further, the nailing fin 220 may, in a known manner, bend toward the top, bottom and side walls of the main frame, to reduce the width and height of the window for shipping.

Figure 2:
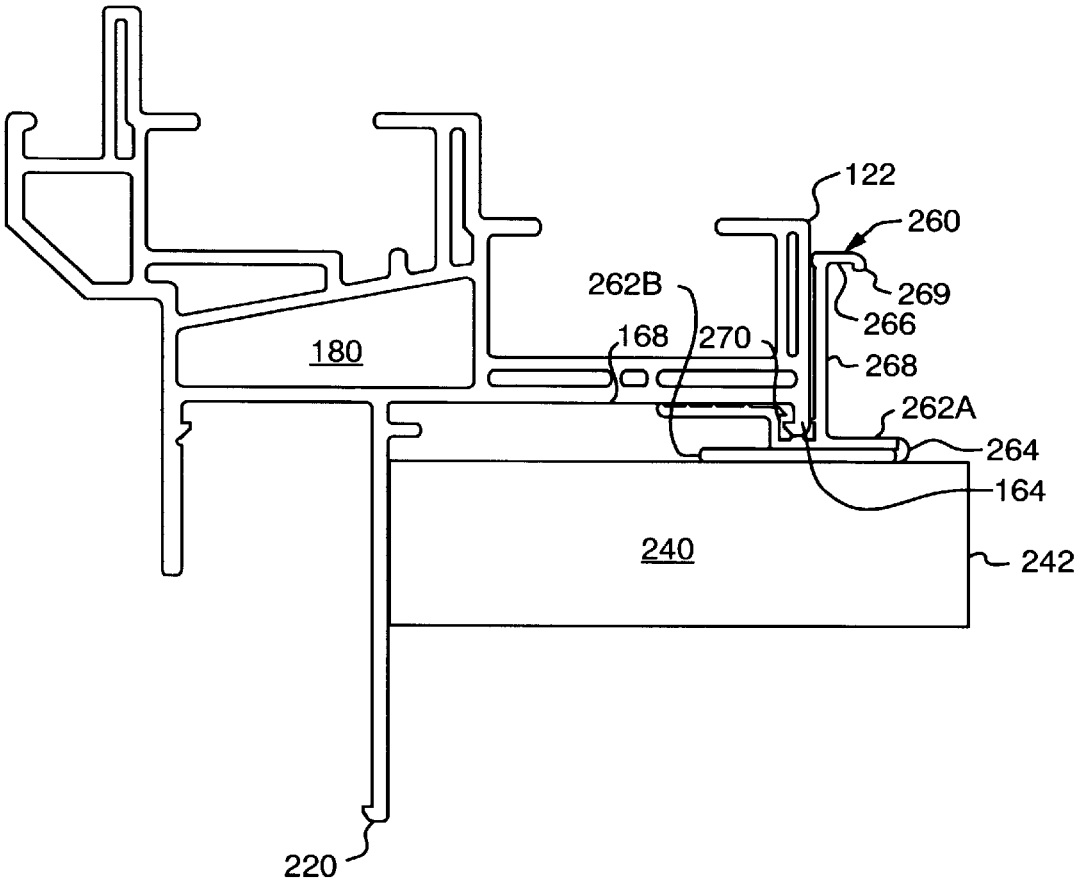
FIG. 2 is a side view of a section of the window of FIG. 1 and includes a side view of a trim clip that positions the trim in one of two orientations.
Figure 3:
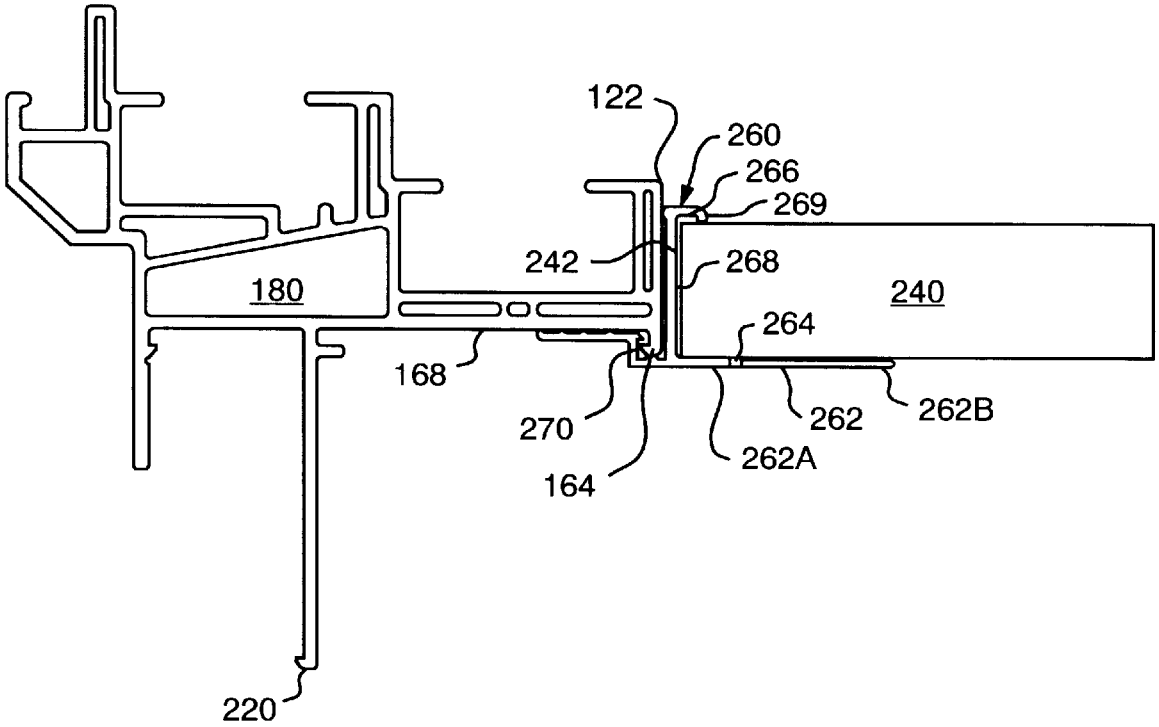
FIG. 3 is a side view of the section of the window depicted in FIG. 2, with the trim clip positioning and holding the trim in a second orientation.

FIG. 2 depicts the jamb 180 and the attached clip 260 and trim 240 in profile. The trim 240 is rotated back against a back wall 168 of the jamb 160, to reduce the depth of the window for shipping. FIG. 3 depicts the jamb 180, and the attached clip 260 and trim 240 in profile, with the trim extending outwardly and in position for installation of the window.

Referring now to FIG. 2, the clip 260 includes a base 262, which consists of two sections 262*a* and 262*b* that are joined by a hinge 264. The trim 240 is attached to the base section 262*b* by, for example, staples or fasteners. The base section 262*b* rotates via hinge 264, to draw the trim 240 back along, or parallel to, the back wall 168 the jamb 180. The clip 260 is preferably made of vinyl, and the hinge 264 is a strip of thinned vinyl that extends across the base 262. The clip is thus relatively inexpensive to manufacture.

The clip 260 further includes an inverted J-shaped section 266 that is perpendicular to the base 262. When the clip is installed on the main frame, a rear wall 268 of the J-shaped section 266 is parallel to the interior wall 122 of the jamb.

As discussed in more detail with reference to FIG. 3 below, when the trim extends outwardly from the frame 180, the J-shaped section 266 retains an end 242 of the trim 240.

The clip 260 fastens to a hook 164 that extends downwardly from the interior wall 122 of the jamb 180. The base 262 of the clip 260 includes a detent 270 that is shaped to mate with the hook. The sill 160 and the head 140 (FIG. 1) also include hooks (not shown), to which the clips 260 attach. The clips 260 are thus easily and quickly installed on the main frame.

Referring now to FIG. 3, the trim 240 is rotated to its outwardly extending orientation and the end 242 is held against rotation by the J-shaped section 266. The J-shaped section 266 includes at its free end a downwardly pointing lip 269 that grips the end 242 of the trim, and prevents the trim from rotating under its own weight. The base 262 thus need not be locked against rotation in order to support the relatively heavy trim in this outwardly extending orientation.

After the trim 240 is held in place by the J-shaped section 266, the installer may, in a conventional manner, nail the trim to the interior walls 122 of the main frame 120.

Using the clips 260 allows the manufacturer to minimize the depth of the fully assembled window for shipping, without significantly increasing the time to assemble or the cost of manufacture of the window.

The foregoing description has been limited to a specific embodiment of this invention. It will be apparent, however, that variations and modifications, such as the use of various materials to construct the trim clip and/or differences in the overall shape of the section that receives the end of the trim, may be made to the invention, with the attainment of some or all of its advantages. Therefore, it is the object of the appended claims to cover all such variations and modifications as come within the true spirit and scope of the invention.

What is claimed is:

1. A clip for attaching trim to a window frame, the clip including:

A. a hinged base including first and second sections that are rotatably connected, the first section of the hinged base for connecting also to the trim and i. rotating in one direction relative to the second section to a first position in which the first section is below and in parallel with the second section of the hinged base, and ii. rotating in an opposite direction relative to the second section to a second position in which the first section extends outwardly from the second section of the hinged base B. an inverted J-shaped section that is perpendicular to the hinged base for holding the trim against rotation when the hinged base positions the trim in the second position; and C. means for attaching the clip to the window frame, the means being for orienting the clip such that the J-shape section is parallel to an interior wall of the window frame.

2. The clip of claim 1 further including a lip that projects downwardly from the J-shaped section, the lip for gripping the trim that is being held by the J-shaped section.

3. The clip of claim 1 wherein the first and second sections of the hinged base each include first and second ends, and the first section rotates in one direction to position the second end of the first section and the first end of the second section in parallel alignment and rotates in the opposite direction to position the second end of the first section in end-to-end alignment with the first end of the second section.

4. A window including:

A. a main frame, the frame having a head, a sill and side jambs, each with an interior wall and a peripheral wall;

B. trim that has a first end, a mid-section and a second end;

C. one or more clips that attach to the main frame, each clip including i. a hinged base that includes a first section and a second section with the first section rotating relative to the second section, the first section attaching to the trim and rotating in one direction to a first position in which the trim is held in parallel with the peripheral wall of the frame and rotating in an opposite direction to a second position in which the second end of the trim is held adjacent to the interior wall of the frame; and ii. an inverted J-shaped section that is perpendicular to the hinged base for receiving the second end of the trim when the first section of the hinged base is in the second position, the inverted J-shaped section holding the end of the trim against rotation.

5. The window of claim 4 further including in the J-shaped section a lip that projects downwardly to grip the second end of the trim.

6. The window of claim 4 further including

D. on the periphral walls of the main frame, a hook for receiving the clip;

E. on the clip, a detent for mating with the hook.

7. The window of claim 6 wherein the detent is formed in the base of the clip.

8. The window of claim 3, wherein the first section of the hinged base attaches to the mid-section of the trim such that second end of the trim overlaps the first end of the second section of the hinged base when the first section is in the second position.

* * * * *